US009482427B2

(12) United States Patent
Brückner et al.

(10) Patent No.: US 9,482,427 B2
(45) Date of Patent: Nov. 1, 2016

(54) METHOD FOR OPERATING A ONCE-THROUGH STEAM GENERATOR AND FORCED-FLOW STEAM GENERATOR

(75) Inventors: Jan Brückner, Uttenreuth (DE); Joachim Franke, Nürnberg (DE); Frank Thomas, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1091 days.

(21) Appl. No.: 12/743,881

(22) PCT Filed: Nov. 14, 2008

(86) PCT No.: PCT/EP2008/065522

§ 371 (c)(1),
(2), (4) Date: May 20, 2010

(87) PCT Pub. No.: WO2009/068446

PCT Pub. Date: Jun. 4, 2009

(65) Prior Publication Data

US 2010/0288210 A1 Nov. 18, 2010

(30) Foreign Application Priority Data

Nov. 28, 2007 (EP) ..... 07023081

(51) Int. Cl.

| | |
|---|---|
| ***F22D 5/26*** | (2006.01) |
| ***F22B 35/10*** | (2006.01) |
| ***F22B 35/12*** | (2006.01) |
| ***F22B 37/38*** | (2006.01) |

(52) U.S. Cl.

CPC ..... *F22B 37/38* (2013.01)

(58) Field of Classification Search

None

See application file for complete search history.

(56) References Cited

U.S. PATENT DOCUMENTS

| | | | | | |
|---|---|---|---|---|---|
| 3,038,453 | A | * | 6/1962 | Armacost | 122/406.4 |
| 3,162,179 | A | * | 12/1964 | Strohmeyer, Jr. | 122/406.4 |
| 3,164,136 | A | * | 1/1965 | Fritz | 122/479.7 |
| 3,186,175 | A | * | 6/1965 | Strohmeyer, Jr. | 60/678 |
| 3,189,008 | A | * | 6/1965 | Schroedter et al. | 122/451.1 |
| 3,199,494 | A | * | 8/1965 | Strohmeyer, Jr. | 122/1 B |
| 3,216,403 | A | * | 11/1965 | Vagn | 122/451 S |
| 3,220,193 | A | * | 11/1965 | Strohmeyer, Jr. | 60/659 |

(Continued)

FOREIGN PATENT DOCUMENTS

| | | | |
|---|---|---|---|
| DE | 1145739 B | | 3/1963 |
| DE | 1145739 B | * | 3/1963 |

(Continued)

*Primary Examiner* — Gregory Huson
*Assistant Examiner* — Eric Gorman

(57) ABSTRACT

A method for operating a once-through steam generator including an evaporator heating surface is provided. A target value for the supply water mass flow is fed to a device for setting the supply water mass flow, which is predefined using the ratio of the heat flow currently being transferred in the evaporator heating surface from the hot gas to the flow medium to a target enthalpy increase predefined with respect to the desired live steam condition of the flow medium in the evaporator heating surface. A forced-flow steam generator used for carrying out the method is also provided. The heat flow transferred from the hot gas to the flow medium is ascertained for this purpose allowing for a specific temperature value characteristic of the current temperature of the hot gas at the evaporator inlet and a specific mass flow value characteristic for the current mass flow of the hot gas.

9 Claims, 2 Drawing Sheets

(56) References Cited

U.S. PATENT DOCUMENTS 3,312,198 A * 4/1967 Eckerlin ..... 122/406.4
3,470,853 A * 10/1969 Klaus ..... 122/406.4
3,478,726 A * 11/1969 Kikinis ..... F22B 29/023 122/406.1
3,508,526 A * 4/1970 Rupprecht ..... F22B 31/045 122/406.4
3,550,562 A * 12/1970 Strohmeyer, Jr. ..... 122/448.4
3,572,036 A * 3/1971 Beckman et al. ..... 60/646
3,592,170 A * 7/1971 Burkle ..... 122/406.4
3,665,895 A * 5/1972 Sauter ..... 122/406.5
3,690,303 A * 9/1972 Dolezal ..... 122/406.4
3,774,396 A * 11/1973 Borsi et al. ..... 60/645
3,946,566 A * 3/1976 Hochmuth ..... 60/646
3,970,832 A * 7/1976 Itschner ..... 702/136
3,985,523 A * 10/1976 Kaupas et al. ..... 95/193
4,031,404 A * 6/1977 Martz et al. ..... 290/40 R
4,290,389 A * 9/1981 Palchik ..... 122/406.4
4,294,200 A * 10/1981 Gorzegno ..... 122/406.4
4,353,204 A * 10/1982 Arakawa ..... F01K 9/00 122/7 R
4,572,110 A * 2/1986 Haeflich ..... 122/7 R
4,593,881 A * 6/1986 Yoshino ..... 251/124
4,665,709 A * 5/1987 Perry ..... 62/141
4,864,826 A * 9/1989 Lagow ..... 60/670
4,869,210 A * 9/1989 Wittchow ..... 122/451 S
4,915,062 A * 4/1990 Dolezal ..... 122/406.5
4,915,792 A * 4/1990 Zeilon ..... 203/22
4,941,113 A * 7/1990 Dundics et al. ..... 702/83
5,044,163 A * 9/1991 Bruckner et al. ..... 60/677
5,056,468 A * 10/1991 Wittchow et al. ..... 122/451 S
5,189,988 A * 3/1993 Budin et al. ..... 122/6 A
5,245,836 A * 9/1993 Lorentzen et al. ..... 62/174
5,529,021 A * 6/1996 Butterlin et al. ..... 122/448.1
5,713,311 A * 2/1998 Fitzgerald ..... F22B 29/12 122/235.11
5,735,236 A * 4/1998 Kastner et al. ..... 122/6 A
5,771,846 A * 6/1998 Ruchti ..... F22D 5/32 122/451 R
5,771,849 A * 6/1998 Hamy ..... F01L 3/205 123/73 R
5,809,943 A * 9/1998 Olia ..... 122/451 S
5,839,396 A * 11/1998 Franke et al. ..... 122/406.5
5,980,736 A * 11/1999 Putz et al. ..... 210/104
5,983,639 A * 11/1999 Kral ..... F22B 35/14 110/101 C
5,987,876 A * 11/1999 Ziegner ..... 60/776
6,019,070 A * 2/2000 Duffy ..... 122/209.1
6,044,804 A * 4/2000 Franke et al. ..... 122/448.1
6,192,837 B1 * 2/2001 Wittchow ..... 122/406.4
6,212,873 B1 * 4/2001 Sugishita et al. ..... 60/39.182
6,250,258 B1 * 6/2001 Liebig ..... F22B 1/1815 122/1 B
6,446,580 B2 * 9/2002 Franke et al. ..... 122/6 A
7,007,473 B2 * 3/2006 Nagatani et al. ..... 60/616
7,428,374 B2 * 9/2008 Franke et al. ..... 392/396
7,624,708 B2 12/2009 Butterlin et al.
2002/0127177 A1 * 9/2002 Gottzmann et al. ..... 423/650
2002/0157618 A1 * 10/2002 Franke et al. ..... 122/406.4
2003/0024488 A1 * 2/2003 Bingham et al. ..... 122/235.16
2004/0069249 A1 * 4/2004 Kemp ..... F22D 5/30 122/505
2005/0045117 A1 * 3/2005 Rowe ..... F22B 35/18 122/448.1
2005/0166609 A1 * 8/2005 Thybo et al. ..... 62/126
2005/0257753 A1 * 11/2005 Franke et al. ..... 122/406.4
2006/0288962 A1 * 12/2006 Franke et al. ..... 122/1 C
2007/0028859 A1 * 2/2007 Franke et al. ..... 122/460
2007/0034167 A1 * 2/2007 Franke et al. ..... 122/7 R
2008/0066695 A1 * 3/2008 Butterlin et al. ..... 122/406.1
2009/0071419 A1 * 3/2009 Franke ..... F22B 29/06 122/7 R
2011/0011090 A1 * 1/2011 Kral et al. ..... 60/646
2011/0139094 A1 * 6/2011 Bruckner et al. ..... 122/451.1
2011/0225972 A1 * 9/2011 Bruckner et al. ..... 60/645
2013/0133751 A1 * 5/2013 Backi et al. ..... 137/11
2013/0167504 A1 * 7/2013 Bruckner ..... F01K 13/02 60/39.182
2013/0192229 A1 * 8/2013 Bruckner et al. ..... 60/660
2013/0224078 A1 * 8/2013 Van Grambezen et al. .. 422/134
2013/0323139 A1 * 12/2013 Batt et al. ..... 422/292
2014/0014089 A1 * 1/2014 Arai ..... 126/263.01
2014/0109547 A1 * 4/2014 Bruckner et al. ..... 60/39.182
2014/0223911 A1 * 8/2014 Ikegami et al. ..... 60/671
2015/0027162 A1 * 1/2015 Ohno ..... B60H 1/00278 62/525

FOREIGN PATENT DOCUMENTS

DE 4217626 A1 12/1993
EP 0639253 11/1993
EP 1614962 A1 1/2006
FR 2133672 A1 12/1972
JP 2002507272 A 3/2002
TW 212826 9/1993
TW 200634258 A 10/2006
WO WO 2006/005708 A1 1/2006

* cited by examiner

METHOD FOR OPERATING A ONCE-THROUGH STEAM GENERATOR AND FORCED-FLOW STEAM GENERATOR

CROSS REFERENCE TO RELATED APPLICATIONS

This application is the US National Stage of International Application No. PCT/EP2008/065522, filed Nov. 14, 2008 and claims the benefit thereof. The International Application claims the benefits of European Patent Office application No. 07023081.8 EP filed Nov. 28, 2007. All of the applications are incorporated by reference herein in their entirety.

FIELD OF INVENTION

The invention relates to a method for operating a once-through steam generator having an evaporator heating surface in which a device for setting the supply water mass flow $\dot{M}$ is fed a target value $\dot{M}s$ for the supply water mass flow $\dot{M}$. It further relates to a forced-flow steam generator for carrying out the method.

BACKGROUND OF INVENTION

In a once-through steam generator the heating of a number of steam generator tubes which together form an evaporator heating surface leads to a complete evaporation of a flow medium in the steam generator tubes in one pass. The flow medium—usually water—is generally fed before its evaporation to a preheater, usually also referred to as an economizer, connected upstream on the flow medium side from the evaporator heating surface and preheated there.

As a function of the operating state of the once-through steam generator and associated therewith as a function of the current steam generator output the feed water mass flow in the evaporator heating surface is regulated. With changes in load the evaporator flow should be changed as synchronously as possible with the input of heat into the evaporator heating surface, because otherwise a deviation of the specific enthalpy of the flow medium at the exit of the evaporator heating surface from the target value cannot be securely avoided. Such an unwanted deviation of the specific enthalpy makes the regulation of the temperature of the fresh steam exiting from the steam generator and also leads to high material stresses and thus to a reduced lifetime of the steam generator.

To keep deviations of the specific enthalpy from the target value and the resulting unwanted large temperature fluctuations in all operating states of the steam generator, i.e. especially also in transient states or during changes in load, as low as possible, the supply water flow regulation can be embodied as a type of a so-called predictive design. In such cases the necessary supply water target values, especially also during a change of load, should be provided as a function of the current operating state or of the state to be expected in the near future.

A once-through steam generator is known from EP 0639 253 in which the supply water flow is regulated using a predictive calculation of the necessary amount of supply water. The calculation method is based in this case on the heat flow balance of the evaporator heating surface in which the supply water mass flow, especially at the entry of the evaporator heating surface, should be included. The target value for the supply water mass flow is predetermined on the one hand from the ratio of the heat flow transferred in the evaporator heating surface to the flow medium and on the other hand from a target enthalpy increase of the flow medium in the evaporator heating surface predetermined in respect of the desired live steam state.

In practice the measurement of the supply water mass flow directly at the entry of the evaporator heating surface however proves technically complex and is not able to be carried out reliably in each operating state. Despite this the supply water mass flow is measured instead at the entry to the economizer and included in the calculations of the supply water mass flow at the entry of the evaporator heating surface.

To counter the imprecisions caused by this in the predetermination of an especially demand-related target value especially during changes in load for the supply water mass flow, in an alternate concept of a predictive mass flow regulation, as is known in WO 2006/005708 A1, there is provision to take into consideration the supply water density at the entry of the economizer as one of the input variables for the supply water flow regulation.

Both said concepts for a predictive mass flow regulation are based as a major input variable on the target value for the steam generator power, from which on the basis of stored correlations and especially referring back to previously obtained calibration or reference measurements, the characteristic values included in the actual target flow value determination are calculated. This however requires system characteristics which are sufficiently stable and able to be referred back to a firing power, as are usually present with fired steam generators. In other systems, such as when the once-through steam generator is designed as a waste-heat boiler for heat recovery from the flue gas of an upstream gas turbine for example, these types of conditions are not available. In addition, with such systems connected as waste-heat boilers, a firing power is not usable to the same degree as a free parameter as with directly-fired boilers, since with a connection as waste-heat boilers the operation of the gas turbine is usually seen as the primary criterion for controlling the overall system, to the system state of which the other components are adapted.

SUMMARY OF INVENTION

The underlying object of the invention is thus to specify a method for operating a steam generator of the type specified above, which, while keeping outlay comparatively low, even when the steam generator is operated as a waste-heat boiler, makes possible a setting of the supply water mass flow the evaporator heating surface adapted especially well to the current or to the expected heat input into the evaporator heating surface. Furthermore a forced-flow steam generator especially suitable for carrying out the method is to be specified.

With regard to the method this object is inventively achieved by the heat flow transferred from the hot gas to the flow medium being determined taking into account a specific temperature characteristic for the actual temperature of hot gas at the evaporator input and a specific mass flow characteristic for the current mass flow of the hot gas.

The invention is based on the idea here that a sufficiently reliable predictive mass flow regulation also able to be used for a steam generator connected as a waste-heat boiler should be largely adapted to the peculiarities of the waste-heat boiler. In this case it should particularly be taken in account that, unlike with fired boilers, in this case the firing power is not a suitable parameter which allows a sufficiently reliable deduction of the underlying heat flow balance. In particular account should be taken in this case that for an equivalent value for waste-heat boilers, namely the current gas turbine power or parameters correlating with this, further gas-turbine-internal parameters can also occur, so that on the basis of these values it is not possible to draw any acceptable conclusion about the enthalpy circumstances on entry of the hot gas into the flue gas duct of the steam generator. For the heat flow balance used as a basis for determining the needed supply water flow there should therefore be reference back to other, especially suitable parameters. In this case the hot gas temperature on entry into the evaporator as well as the mass flow of the hot gas are provided for this purpose.

In this way a pre-controlled calculation of the required amount of supply water is made possible on the basis of the heat flow balancing of the evaporator, which can if necessary optionally also include subsequent superheater surfaces. The specific temperature characteristic for the current temperature of the hot gas at the evaporator entry in this case especially makes it possible to determine a characteristic value for the hot gas enthalpy which is especially reliable and thus appropriate to demand taking into account the hot gas enthalpy at the evaporator outlet, which for its part can be calculated on the basis of the specific mass flow characteristic for the current mass flow and thereby an especially reliable and appropriate determination of the current heat provision or surplus from hot gas to the supply water. Taking into account the predetermined target enthalpy increase, i.e. especially the difference between the target enthalpy of the flow medium at the evaporator outlet taking into account the desired live steam parameter and the actual enthalpy at the evaporator outlet determined from suitable measured values such as pressure and temperature for example, the desired target enthalpy increase of the flow medium into the evaporator heating surface can be determined from this, with a target value for the supply water mass flow suitable for this able to be calculated from the ratio of these values.

A characteristic value especially representative for the current situation is preferably taken into account as a specific temperature characteristic and/or a specific mass flow characteristic suitable for quantitative description of the hot gas entering into the evaporator. Such characteristic values can be suitably determined on the basis of measurement data currently present and can especially be suitably provided by referring back to stored characteristic memory values. An especially reliable evaluation of the heat flow balance and thus the determination of an especially accurate pre-calculated supply water target value are made possible however by a currently detected measurement value advantageously being taken into account as a specific temperature characteristic and/or as a specific mass flow characteristic.

The heat flow transferred from the hot gas to the flow medium is advantageously determined on the basis of the heat flow balance, for which the difference in enthalpy of the hot gas between evaporator entry and evaporator exit is used as an underlying significant input variable. For an especially reliable characteristic value calculation in such cases account is also taken in a further advantageous embodiment that the reduction of the energy content in the flue gas reflected by the enthalpy difference on its passage through the evaporator heating surface, although it can lead on the one hand to an enthalpy increase in the flow medium within the evaporator heating surface, on the other hand can also lead to energy input or output effects in the components of the evaporator, i.e. especially in the steam generator tubes and other metallic components. For an especially reliable determination of the enthalpy difference actually transferred to the flow medium within the evaporator heating surface, this aspect of the energy input and/or output of heat into the metal masses will be suitably regarded as a characteristic correction value by which the enthalpy difference of the hot gas will be suitably modified.

The current enthalpy of the hot gas will advantageously be taken into account in the determination of the enthalpy difference of the hot gas by being determined on the basis of the pressure of the flow medium at the evaporator inlet, taking into account the specific mass flow characteristic for the current mass flow of the hot gas. The specific mass flow characteristic, which is preferably present in such cases in the form of a measured value, but alternately can be calculated using further parameters by referring back to stored correlation values or other characteristic values, is in such cases advantageously converted into the so-called "pinch-point" of the steam generator, i.e. into the temperature difference between the outlet temperature of the flue gas and the boiling temperature of the flow medium and the evaporator inlet, with this temperature difference expediently being added to a boiling temperature of the flow medium determined on the basis of the pressure at the evaporator inlet and the enthalpy of the hot gas at the evaporator outlet being determined from this sum.

The determination of the target enthalpy increase in the evaporator heating surface is advantageously based on the one hand, using suitable measured values such as the pressure and the temperature of the flow medium at the evaporator inlet for example, on the actual enthalpy determined. In addition, as a function of or taking into account the desired steam state, for example the specified steam parameters or also the steam content at the evaporator outlet, taking into account the current pressure of the flow medium at the outlet of the evaporator heating surface, a target value for its enthalpy at the evaporator outlet is predetermined.

The once-through steam generator can be operated in this case in a so-called "Benson control mode". In this case, in the event of control in the Benson control mode, there is overheating of the flow medium at the outlet of the evaporator heating surface. However in this mode the oversupply of a water reservoir connected downstream of the evaporator heating surface can be taken into account and the subsequent heating surfaces can partly be supplied with still unevaporated flow medium so that the full evaporation of the flow medium is only undertaken in the subsequent heating surfaces. In such a mode the setting of a target temperature above the saturation temperature of the flow medium by a predetermined temperature difference of for example 35° C. can especially be predetermined for the flow medium at the output of the evaporator. Precisely with such a mode of operation of the steam generator it can be desirable to take suitable account of the current operating state of the superheater heating surfaces connected downstream from the evaporator heating surface in that their cooling requirement is transferred to a suitable increased supply of the system with supply water. For this purpose the predetermination of the target value for the enthalpy of the flow medium at the outlet of the evaporator heating surface takes account of the current cooling requirements at injection coolers connected downstream from the evaporator heating surface. The target live steam temperature should thus especially as far as possible be achieved by a suitable setting of the supply of water flow so that the additional cooling requirement at the injection coolers can be kept especially low. Conversely, in the event of a live steam temperature which is too low being established, the enthalpy target value of the flow medium at the evaporator outlets can be suitably increased so that a supply water amount dimensioned correspondingly low can be supplied via the target value for the supply of water mass flow modified in such a way.

Alternately the steam generator can also be operated in a so-called "level control mode" in which the water level in a reservoir connected downstream from the evaporator heating surface is varied and adjusted, with an oversupply of the reservoir being avoided where possible. In this case the water level within the reservoir is kept as far as possible within a predetermined target range with, in an advantageous embodiment of the target value for the supply water mass flow, a fill level correction value being taken into account which characterizes the deviation of the actual state of the fill level in the reservoir from an assigned target value.

In relation to the once-through steam generator the desired object is achieved by a supply of water flow regulation assigned to a device for adjusting the supply water mass flow being designed to predetermine the target value for the supply water mass flow on the basis of the said method. The once-through steam generator is embodied in this case in an especially advantageous manner as a waste-heat steam generator to which the waste heat from an assigned gas turbine system is supplied on the hot gas side.

The advantages achieved with the invention are particularly that explicitly taking into account a characteristic value for the current temperature of the flue gas on entry into the hot gas duct and/or for the current mass flow of the waste gas, a predictive or preventive determination of a supply water mass flow target value especially largely oriented to the expected demand is made possible, whereby even in the event of the steam generator being used as a waste-heat boiler and a consequential only insufficient correlation of the corresponding enthalpy characteristic values with the power or supply value of the system, an especially reliable and stable regulation behavior is able to be achieved. This means that an especially reliable predictive adaptation of the supply water flow through the evaporator heating surface to the current or expected heat input of the evaporator heating surface is made possible in an especially simple and reliable manner in all possible operating states of the once-through steam generator, with the deviation of the specific enthalpy of the flow medium at the outlet of the evaporator heating surface from the target value able to be kept especially low.

An exemplary embodiment of the invention is explained in greater detail with reference to a drawing. The figures show:

Both parts are provided with the same reference signs in the two figures.

DETAILED DESCRIPTION OF INVENTION

Figure 1:
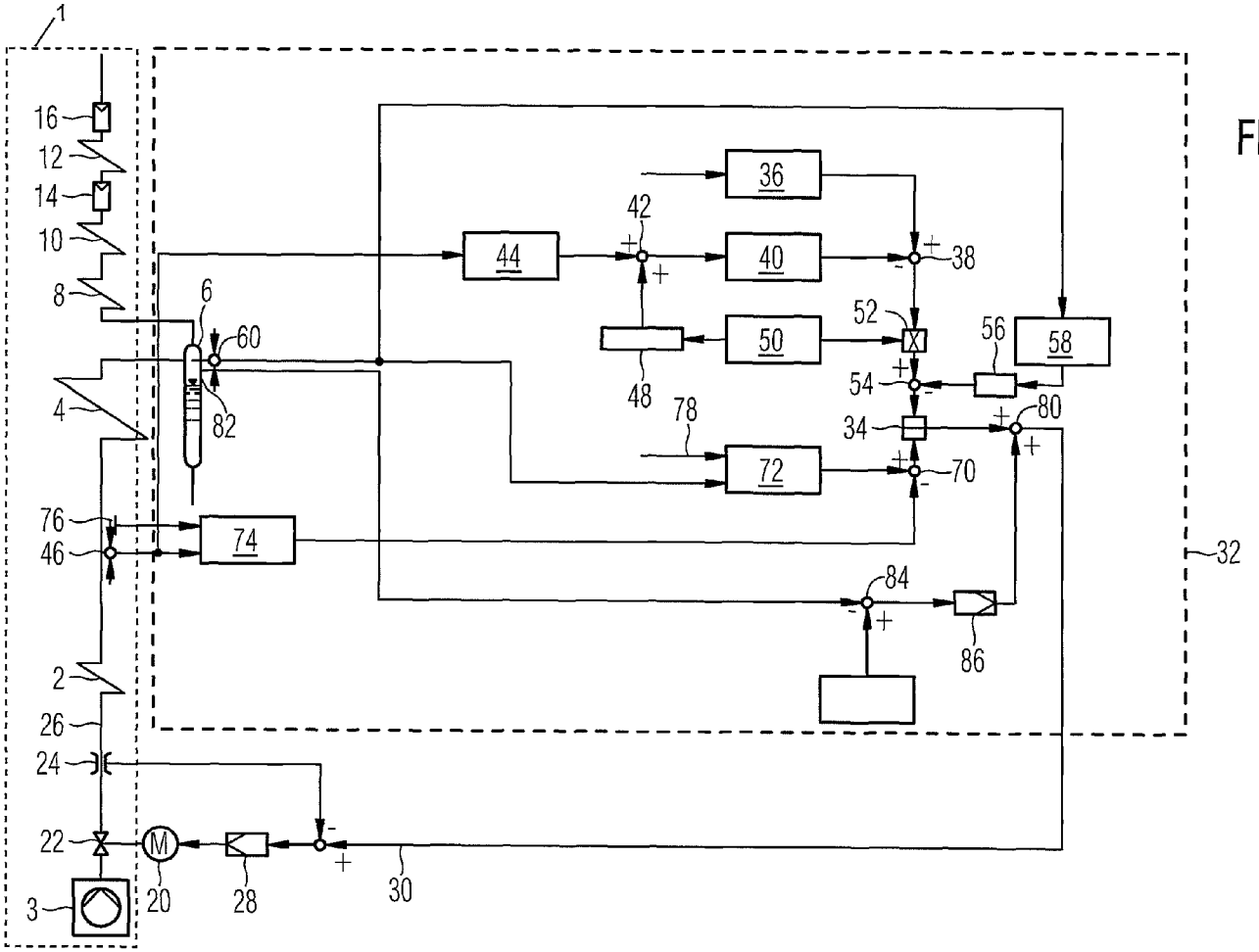
FIGS. 1 and 2 respectively a once-through steam generator with assigned supply water flow regulation.

The forced-flow steam generators 1, 1' in accordance with FIG. 1, 2 each feature a preheater referred to as an economizer 2 for supply water intended as a flow medium which is located in a gas pipe not shown a greater detail. The economizer 2 is connected on the flow medium side upstream from a supply water pump 3 and downstream from an evaporator heating surface 4. On the output side the evaporator heating surface 4 is connected via a water reservoir 6 which can also especially be embodied as a water separator or separation vessel, to a number of downstream superheater heating surfaces 8, 10, 12, which for their part can be provided, for adapting the steam temperatures and the like, with injection coolers 14, 16. The forced-flow steam generators 1, 1' are each embodied as a waste-heat boiler or waste-heat steam generator, with the heating surfaces, i.e. especially of the economizer 2, the evaporator heating surface 4 as well as the superheater heating surfaces 8, 10, 12 being arranged in a hot gas duct to which the exhaust gas is applied from an assigned gas turbine system on the hot gas side.

The forced-flow steam generator 1, l' is designed to have supply water applied to it in a regulated manner. To this end the supply water pump 3 is connected downstream from a throttle valve 22 activated by a control motor 20, so that by suitable activation of the throttle valve 22 the amount of supply water demanded by the supply water pump 3 in the direction of the economizer 2 or the supply water mass flow can be adjusted. To determine a current characteristic value for the supply water mass flow provided, the throttle valve 22 has a measurement device 24 for determining the supply water mass flow $\dot{M}$ through the supply water line 26 connected downstream from it. The control motor 20 is activated by a regulator element 28, to the input side of which a target value $\dot{M}s$ supplied via a data line 30 for the supply water mass flow $\dot{M}$ and the current target value of the supply water mass flow $\dot{M}$ determined via a measurement device 24 are applied. By forming the difference between these two signals an adjustment requirement is transferred to the regulator 28 so that, for a deviation of the actual value from the target value, a corresponding adjustment of the throttle valve 22 is undertaken by the activation of the motor 20.

To determine a target value $\dot{M}s$ especially suited to demand for the supply water mass flow $\dot{M}$ as a type of setting which is in the nature of a prediction, forecast or value oriented to the future or current demand of the supply water mass flow, the data line 30 is connected on the input side to a supply water flow regulator 32, 32' designed for predetermining the target value $\dot{M}s$ for the supply water mass flow $\dot{M}$. This is designed for determining the target value $\dot{M}s$ for the supply water mass flow $\dot{M}$ on the basis of a heat flow balance in the evaporator heating surface 4, with the target value $\dot{M}s$ for the supply water mass flow $\dot{M}$ being determined on the one hand on the basis of the ratio of the heat flow currently transferred into the evaporator heating surface 4 from the hot gas to the flow medium and a predetermined target enthalpy increase of the flow medium into the evaporator heating surface 4 in respect of the desired live steam state on the other hand. A use of this type of concept for providing a target value for the supply water mass flow based on a heating balance even for a forced-flow steam generator 1, 1' constructed as a waste-heat boiler is especially achieved in the exemplary embodiments in accordance with FIG. 1, FIG. 2 by the heat flow transmitted from the hot gas to the flow medium being determined taking into consideration a specific temperature characteristic for the current temperature of the hot gas at the evaporator inlet and a specific mass flow characteristic for the current mass flow of the hot gas.

To this end the supply water flow regulation 32 features a division element 34 which is supplied as a numerator with a suitable characteristic value for the actual heat flow transferred in the evaporator heating surface 4 from the hot gas to the flow medium and as a denominator a suitably predetermined characteristic value in respect of the desired live steam state for the desired target enthalpy increase of the flow medium in the evaporator heating surface 4. On the numerator side the division element 34 is connected on its input side in this case with a function module 36 which, on the basis of a specific temperature characteristic supplied for the current temperature of the hot gas at the evaporator inlet, outputs a value for the enthalpy of the hot gas at the evaporator inlet. In the exemplary embodiment in this case the supply of a characteristic measured value for the current temperature of the hot gas at the evaporator inlet is provided as a specific temperature characteristic. The characteristic value for the enthalpy of the hot gas at the evaporator is output to a subtraction element, where a characteristic value for the enthalpy of a gas at the evaporator outlet delivered by a function module 40 is subtracted from this characteristic value.

To determine the enthalpy of the hot gas at the evaporator outlet, the sum of two temperature values is formed by a summation element 42 on the input side for the function element 40. In this case on the one hand the saturation temperature of the flow medium determined by a function element 44 which is connected on the input side to a pressure sensor 46 on the basis of the pressure of the flow medium at the evaporator inlet is taken into consideration. On the other hand the so-called pinch point, namely the temperature difference determined from the mass flow of the hot gas of the hot gas temperature at the evaporator outlet minus the boiling temperature of the flow medium at the evaporator inlet is taken into account via a function element 48, which for its part is supplied on the input side via a further function element 50 with a specific mass flow characteristic for the current mass flow of the hot gas. From these two temperature contributions added via the summation element 42 an enthalpy of the hot gas at the evaporator outlet is thus provided by function element 40, if necessary while referring back to suitable tables, diagrams or the like. On the output side the subtraction element 38 thus delivers the enthalpy difference or balance of the hot gas, i.e. the difference between hot gas enthalpy at the evaporator inlet and hot gas enthalpy at the evaporator outlet.

This enthalpy difference is passed on to a multiplier element 52 which is likewise supplied with the specific mass flow characteristic which can additionally be present as the currently recorded measurement value. On the output side the multiplication element 52 thus delivers a characteristic value for the heat power output by the flue gas to the evaporator heating surface 4.

In order to be able to determine the heat flow actually transferred to the flow medium from this heat power output by the hot gas, a correction by heat injection and/or ejection effects into the components of the evaporator heating surface 4, especially into the metal masses, is initially provided. For this purpose the said characteristic value for the heat power output by the hot gas is initially supplied to a subtraction element, where a characteristic correction value for the heat injected into or ejected from the evaporator components is subtracted. This is provided by a function element 56. This in its turn has the output value of a further function element 58 applied to it on its input side by an average temperature value for the metal masses of the evaporator heating surface 4 being determined. For this purpose the further function element 58 is connected on its input side with a pressure sensor 60 arranged in the water reservoir 6, so that the further function element 58 can determine the average temperature of the metal masses on the basis of a pressure of the flow medium, e.g. by equating it with the boiling temperature belonging to this pressure in the water reservoir 6.

On the output side the subtraction element 54 thus transfers a characteristic value for the heat power output by the hot gas reduced by the heat power stored in the metal of the evaporator heating surface 4 and thus for the heat power to be output to the flow medium.

This characteristic value is used in the division element 34 as the numerator, which is divided there by a denominator which corresponds to a predetermined target enthalpy increase in respect of the desired live steam state of the flow medium in the evaporator heating surface 4, so that from this division or this ratio the target value $\dot{M}s$ for the supply water mass flow $\dot{M}$ can be fanned. To provide the denominator, i.e. the characteristic value for the desired target enthalpy increase on the water, steam or flow medium side, a division element 34 is connected on its input side to a subtraction element 70. This has a characteristic value provided by a function element 72 for the desired target value for the enthalpy of the flow medium at the evaporator outlet applied to it on its input side. Furthermore the subtraction elements 70 has a characteristic value actual value for the current enthalpy of the flow medium at the evaporator inlet provided by a function module 74 applied to it on its input side, which is subtracted in the subtraction element 70 from the said characteristic value for the target value of the enthalpy at the evaporator outlet. On the input side the function module 74, for forming the said characteristic value for the actual enthalpy at the evaporator input, is connected to the pressure sensor 46 and to a temperature sensor 76. Thus, by forming the difference in the subtraction elements 70, an enthalpy increase to be included in the evaporator heating surface 4 as a function of the desired live steam state in the flow medium is determined, which can be used as a denominator in the division element 34.

Figure 2:
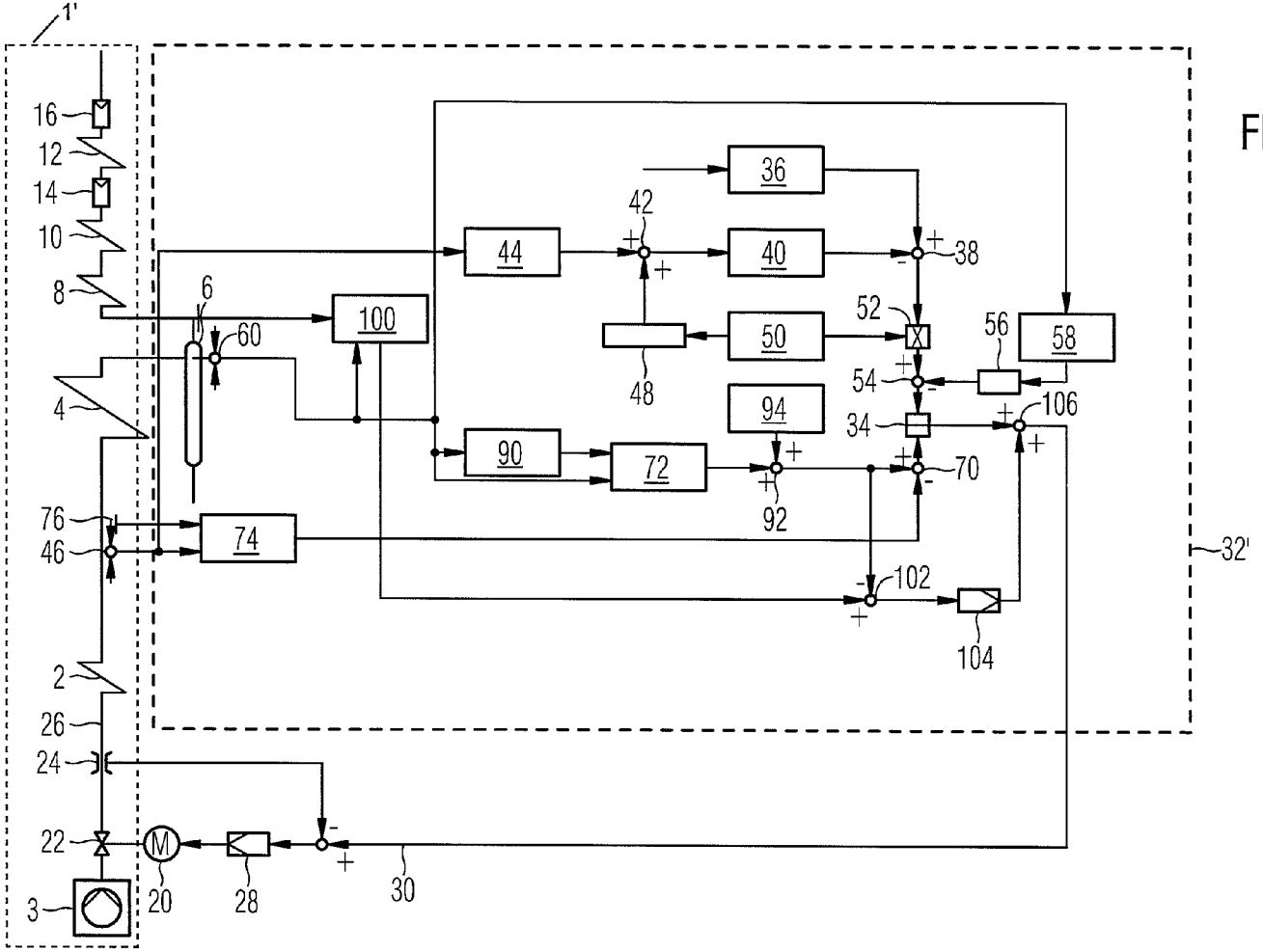

The forced-flow steam generator 1 and the forced-flow steam generator 1' in accordance with FIG. 1 or 2 differ in respect of the design of their supply water flow regulation 32, 32', especially as regards the formation of the target value for the enthalpy at the evaporator outlet and thus in respect of what is applied to the input side of the function module 72. The forced-flow steam generator 1 in accordance with FIG. 1 is in this case designed for operation in so-called "level control mode" in which the water level in the reservoir 6 is controlled, with exclusively steam being passed on to the superheater heating surfaces 8, 10, 12 connected downstream from the evaporator heating surface 4 and the water still carried on the evaporator outlet side being collected in the water reservoir 6. In this operating mode the function module 72 on the one hand has a measured value delivered by the pressure sensor for the pressure in the water reservoir 6 applied to it on its input side. On the other hand a parameter characteristic for the desired live steam state, for example a desired steam content at the evaporator outlet, will be supplied to the function module 72 via an assigned input 78. From this parameter together with the said pressure characteristic value, the target value for the enthalpy of the flow medium at the evaporator outlet is then formed in function module 72.

In the embodiment depicted in FIG. 1 the division element 34 on the basis of the said division delivers on the output side a target value for the supply water mass flow which is aligned and determined on the basis of the said heat balance. This target value is subsequently further corrected however in a downstream addition element by a correction value which reflects a desired change of the level in the water reservoir 6 over the supply water inflow. For this purpose the level in the water reservoir 6 is detected using a fill level sensor 82. The actual value for the fill level is subtracted in a subtraction element 84 from a stored target value or a target value able to be predetermined in some other way for the fill level in the water reservoir 6. On the basis of the deviation of the actual value of the fill level in the water reservoir 6 established in this way from the assigned target value, in a subsequent control element 86 an effective supply water mass flow value is determined which is to be applied to the water reservoir 6 for correcting its fill level. This correction value is added in addition element 80 to the target value for the supply water mass flow determined on the basis of the heat flow balance, so that a value combined from the two components will be output as target value Ms for the supply water mass flow.

By contrast the forced-flow steam generator 1' depicted in FIG. 2 is designed for operation in so-called "Benson Control Mode", in which an oversupply of a water reservoir 6 also intended as a water separator and the complete evaporation of the flow medium is only possible in the subsequent superheater heating surfaces 8, 10, 12. In this operating variant the function element 72 via which the target value for the enthalpy of the flow medium at the evaporator outlet is to be output also on the one hand has the actual value that the pressure in the water separator 6 determined with the pressure sensor 60 applied to it on its input side. Furthermore a further function module 90 is connected upstream from the function module 72 on the input side, which on the basis of the actual pressure in the water reservoir 6 determined by the pressure sensor 60, determines a suitable target value the temperature of the flow medium in the water reservoir 6 on the basis of a stored functionality or of the desired live steam state. For example for an operation of the system in "Benson Control Mode", a temperature value could be stored here as they target value of the temperature which corresponds to the saturation temperature of the flow medium at the determined pressure plus an intended minimum overheating of for example 35° C. The function module 72 determines from this target value from the temperature, taking into account the current pressure value, the said target value for the enthalpy of the flow medium at the evaporator outlet.

In the exemplary embodiment depicted in FIG. 2 this target value provided by function module 72, which is substantially oriented to the properties of the flow medium as such, is subsequently modified again in a downstream addition element by a further correction value. This further correction value supplied by a function module 94 essentially takes account in the form of a trim function of the deviation of the currently established live steam temperature from the live steam temperature actually desired in respect of the desired live steam state. Such a deviation can especially become evident by a need for cooling arising if the live steam temperature in the injection coolers 14, 16 is too high and thus cooling medium needs to be applied to the injection coolers 14, 16. If this type of mass flow is established for the injection coolers 14, 16 a design objective of the function module 94 is to transfer this cooling requirement away from the injection coolers 14, 16 and into an increased supply water feed. With an accordingly established cooling requirement in the injection coolers 14, 16 the desired enthalpy of the flow medium at the evaporator outlet will be lowered accordingly in function module 94 in order to minimize the cooling requirement. Otherwise, i.e. if a live steam temperature which is too low is established, the enthalpy target value is increased by the correction value provided by function module 94 and its addition in addition module 92.

To ensure this the supply water flow control 32' of the forced flow steam generator 1' according to FIG. 2 also comprises a downstream direct control loop in which, in a function module 100 on the basis of the measured values in the water reservoir 6, an actual value for the enthalpy of the flow medium at the evaporator outlet is determined and is compared in a differentiation module 102 with the desired enthalpy, i.e. with the target enthalpy value. In this case the target-actual deviation is established by forming the difference in the differentiation module 102, which via a downstream control 104 in an addition module 106 is overlaid on the target value for the supply water mass flow provided by the division element 34. This overlaying occurs suitably delayed in time and damped so that this control intervention only occurs if necessary, i.e. for a control deviation which is too coarse.

The invention claimed is:

1. A method for operating a once-through steam generator including an evaporator heating surface, comprising:

supplying a device for setting the supply water mass flow with a target value for the supply water mass flow;

calculating the target value using a ratio of a current heat flow transferred in the evaporator heating surface from a hot gas to a flow medium to a predetermined target enthalpy increase of the flow medium in the evaporator heating surface with respect to a desired live steam state wherein the predetermined target enthalpy increase takes into consideration an actual enthalpy at an evaporator heating surface inlet which is determined using a temperature and a pressure, respectively measured using a temperature sensor and a pressure sensor at the evaporator heating surface inlet;

determining the heat flow transferred from the hot gas to the flow medium by taking into account a specific temperature characteristic for the current temperature of the hot gas at the evaporator heating surface inlet and a specific mass flow characteristic for a current mass flow of the hot gas, and wherein the ratio is created using a division element including as a numerator the current heat flow transferred in the evaporator heating surface from the hot gas to the flow medium and as a denominator the predetermined target enthalpy increase of the flow medium in the evaporator heating surface with respect to the desired live steam state.

2. The method as claimed in claim 1, wherein a first current measured value is used for the specific temperature characteristic, and wherein a second current measured value is used for the specific mass flow characteristic.

3. The method as claimed in claim 1, wherein the heat flow transferred from the hot gas to the flow medium is determined on the basis of an enthalpy difference of the hot gas between the heating surface evaporator inlet and an evaporator heating surface outlet.

4. The method as claimed in claim 3, wherein the enthalpy difference of the hot gas is modified for determining the heat flow transferred from the hot gas to the flow medium by a characteristic correction value for the heat input or output into a plurality of evaporator heating surface components.

5. The method as claimed in claim 3, wherein a current enthalpy of the hot gas at the evaporator heating surface outlet is determined on the basis of the pressure of the flow medium at the evaporator heating surface inlet and taking into account the specific mass flow characteristic.

6. The method as claimed in claim 1, wherein the target enthalpy increase of the flow medium in the evaporator heating surface is predetermined by taking into account a current pressure of the flow medium at the evaporator heating surface outlet.

7. The method as claimed in claim 6, wherein in the predetermining of the target enthalpy increase of the flow medium at the evaporator heating surface outlet, a current cooling requirement at a plurality of injection coolers connected downstream from the evaporator heating surface is taken into account.

8. The method as claimed in claim 1, wherein for the target value a fill level correction value is taken into account which characterizes a first deviation of an actual state of the fill level in a water reservoir connected downstream from the evaporator heating surface from an assigned target value.

9. The method as claimed in claim 1, wherein an enthalpy correction value is taken into account for the target value, which characterizes a second deviation of a current level of the enthalpy at the evaporator heating surface outlet from the assigned target value.

* * * * *